US005172568A

United States Patent [19]

Senanayake

[11] Patent Number: 5,172,568

[45] Date of Patent: Dec. 22, 1992

[54] HOLLOW JEWELRY OBJECTS AND METHOD

[76] Inventor: Daya R. Senanayake, 9 Ecrin Place, Colombo 8, Sri Lanka

[21] Appl. No.: 659,356

[22] PCT Filed: Sep. 8, 1989

[86] PCT No.: PCT/LK89/00001

§ 371 Date: Apr. 15, 1991

§ 102(e) Date: Apr. 15, 1991

[87] PCT Pub. No.: WO90/02828

PCT Pub. Date: Mar. 22, 1990

[30] Foreign Application Priority Data

Sep. 9, 1988 [LK] Sri Lanka ..... 9934

[51] Int. Cl.[5] ..... A44C 25/00

[52] U.S. Cl. ..... 63/2; 63/23; 205/72; 205/73

[58] Field of Search ..... 63/12, 23, 2; 205/72, 205/73

[56] References Cited

U.S. PATENT DOCUMENTS

| | | | |
|---|---|---|---|
| 536,259 | 3/1895 | Bloede | 205/72 |
| 789,342 | 5/1905 | Voelke | 205/73 |
| 1,792,542 | 2/1931 | Laukel . | |
| 2,008,005 | 7/1935 | Chilson | 63/23 |
| 2,113,223 | 4/1938 | Salabes | 205/73 |
| 3,686,081 | 8/1972 | Butter et al. | 205/73 |
| 3,853,714 | 12/1974 | Shimada et al. | 205/73 |
| 4,343,684 | 8/1982 | Lechtzin . | |
| 4,464,231 | 8/1984 | Little . | |
| 4,664,758 | 5/1987 | Grey | 205/73 |
| 4,681,664 | 7/1987 | Eberle et al. | 205/73 |
| 4,710,276 | 12/1987 | Kull | 205/72 |
| 4,722,770 | 2/1988 | Blottiere | 205/73 |

FOREIGN PATENT DOCUMENTS 351060 7/1905 France .

*Primary Examiner*—Rodney M. Lindsey
*Assistant Examiner*—Michael T. Milano
*Attorney, Agent, or Firm*—Oblon, Spivak, McClelland, Maier & Neustadt

[57] ABSTRACT

A method of fabricating a hollow jewelry object in which an electrically conductive coating is applied to part (18) of a non-conductive mandrel or mould (10), the coated mandrel being presented for a first dip into an electrolyte containing ions of a precious metal e.g. gold so that the parts of the mandrel are coated with an initial deposit; the mandrel is then removed from the electrolyte and the previously uncoated portions (24) coated before the mould is again dipped in the or a different electrolyte to form an outer shell integral with the internal ribs or points formed during the first dip. Thus the hollow jewelry object is internally strengthened by the ribs; though in an alternative embodiment the ribs can be replaced by individual upstanding projections in bas relief if these conform to the external profile required for the jewelry object. The invention also includes a hollow jewelry object formed by the method according to the invention.

10 Claims, 1 Drawing Sheet

HOLLOW JEWELRY OBJECTS AND METHOD

This invention relates to hollow jewellery objects and method.

Jewellery and ornamental objects intended to be worn on or about the person are often formed of precious metals such as gold and silver and are thus expensive. There have therefore been many attempts to make suitable pieces hollow rather than solid, to reduce the precious metal content. Hollow jewellery is also lighter in weight and often therefore more acceptable to the user, particularly for earrings and necklaces; conversely, larger jewellery objects if hollow may have a similar weight to smaller (solid metal) jewellery so that the range of suitable jewellery objects is extended, in that lifesize hollowform objects such as replicate leaves or flowers can be made of a weight suitable to be worn for several hours.

However hollow jewellery objects need to be strong so that they are not inadvertently crushed during use, such as may occur from normal contact with a hollow necklace object during dancing, or during storage.

One known method of fabricating hollow jewellery objects is by electro-deposition. Our invention is concerned with improvements to the known electro-deposition methods and product.

One prior proposal is that of Lechtzin U.S. Pat. No. 4,343,684 in which a carat gold electroform includes the steps of forming an easily workable substrate, suitably of wax, to a desired configuration, and then applying an electrically conductive surface treatment if necessary. The configured treated substrate is electroplated in a metallic bath until a self-supporting metallic shell, suitably of copper, is formed over the substrate. In known manner, as by being boiled out, the substrate is then removed. The metallic shell is first cleaned, and then placed in a carat gold electroforming bath wherein a gold piece is built to the desired final thickness and carat by controlling current density and plating time. The carat gold electroformed piece can be stress relieved by annealing at elevated temperatures for suitable periods of time, and is thereafter immersed in an acid bath to remove (by dissolving away) the metallic shell from the piece interior, leaving a configured shell of carat gold. The thickness of the gold deposit is above 0.007 inches.

In another prior proposal, the internal mould (the metallic shell of Lechtzin) is left in situ, but with consequential added weight to the jewellery object.

It has also been proposed to provide extra strengthening for the hollow shell, by filling the shell with a relatively lightweight material, such as sealing wax or shellac.

One manufacturer of hollow electroformed gold jewellery produces objects of 18 or 14 carat, with a published typical plating rate of 1 micron in 1.8 minutes, and a deposition time of 3 hours or above i.e. a minimum object wall thickness of 100 microns.

We now propose a two stage object fabrication method, the first stage being to form by electrodeposition one or more internal supports, the second stage being to form by electrodeposition an outer shell upon and integral with the internal support(s). The support or supports is suitably one or more inwardly-facing ribs, preferably a plurality of ribs interconnected to provide a matrix. The rib or matrix provides an internal support for the hollow shell, which can thereby be of reduced thickness. During fabrication the hollow jewellery object is usefully electrodeposited upon a mandrel or mould of a fusible material such as wax, the outer surface of the mould or mandrel being shaped to conform with the electro-deposited article to be produced.

We also provide a hollow jewellery object made by the method of the preceding paragraph.

The invention will be further described by way of example with reference to the accompanying drawings in which.

Figure 1:
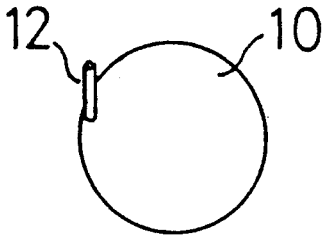
FIG. 1 is of a mould or mandrel, shaped to form a hollow ball (of precious metal), with an attached drain tube.
Figure 6:
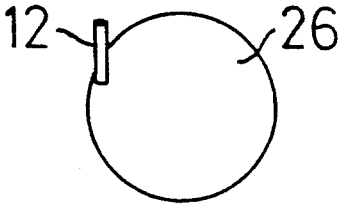
Figure 7:
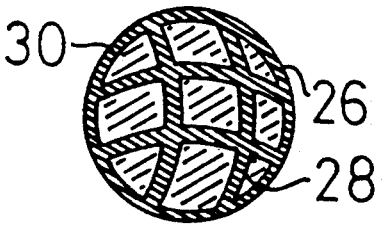

FIG. 6 is a schematic external view of the mould after the completion of the second deposition stage, with the gold coating covering the entire surface (except for the drain tube area); and FIG. 7 is a schematic cross-section view of the hollow gold ball formed about the mould of FIG. 1, with the outer ball (of gold) supported by the internal gold matrix, with the wax melted off and with the drain hole closed by a plug of gold.

The mould or mandrel 10 as seen in FIG. 1 is shown as a sphere, suitable to form a hollow jewellery object in the shape of a ball; though in alternative embodiments the mandrel has another surface shape such as that of an animal or leaf. It will be understood that the outer surface of the mould can be provided with any desired pattern or has-relief, which the designer desires to be reproduced in the finished jewellery object.

In this embodiment the mould 10 is of wax, though another fusible material can be used, for subsequent removal through drain tube 12 when melted; whilst in alternative arrangements the mould can be of a soluble material such as zinc alloy, aluminium alloy or plastics. If desired, the mould or mandrel can be left in situ, and then for jewellery objects would conveniently be of rubber.

Figure 2:
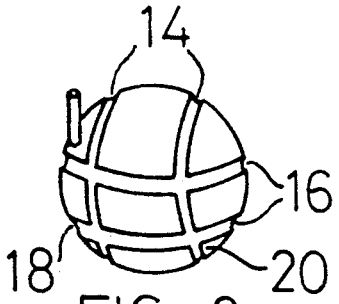
FIG. 2 is of the mould of FIG. 1, but having interconnected indentations etched in its outer surface.

As seen in FIG. 2, a first pair 14 and a second pair 16 of concentric indentations 18 are etched into the outer surface of the mould 10, each pair being perpendicular to the other so as to cross at interconnections 20. In an alternative embodiment, the indentations are cut into the outer surface, rather than etched thereinto; and in yet a further embodiment the indentations are in the form of a plurality of spaced depressions. Instead of indentations, there can be protrubrances projecting outwardly of the mandrel surface, providing such protruberances conform to the required shape of the finished object, for instance if the object is to include the wing of a bird and the protrubrances follow the feather lines; there is an advantage with the more complicated designs with raised portions such as that of a bird's wing, of providing the required shell strengthening without the extra shell thickness from also using an internally projecting rib.

Figure 3:
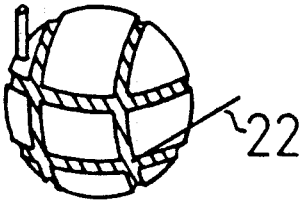
FIG. 3 is of the mould of FIG. 2, with the indentations now coated with an electrically conductive material, with an interconnection joined to an electrical wire.

The indentations 18 are coated with an electrically conductive material such as silver or copper, indicated by the hatching of FIG. 3. An electrically conducting wire 22 is joined to an interconnection 20, whereby all the indentations 18 can be made electrically conducting; in an alternative embodiment wherein the indentations 18 are not interconnected, more than one wire 22 will be provided.

Figure 4:
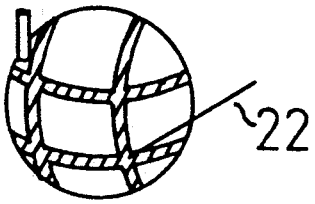
FIG. 4 is of the mould of FIG. 2, with the indentations filled with a deposited material (gold) at the completion of the first electro-deposition stage.
Figure 5:
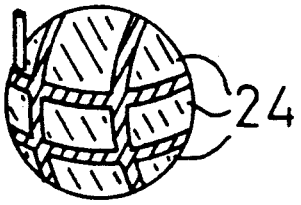
FIG. 5 is a schematic view, not to scale, corresponding to FIG. 4, but with the mould between the gold-filled indentations of FIG. 4 covered with an electrically conductive material.

The coated mould or mandrel 10 is thereafter presented for an initial dip in a first electrolyte, with wire 22 electrically connected to the negative pole of a battery so that the coating in the indentations 18 forms a cathode. Thus the positive ions (gold in this example) from the electrolyte make an initial deposit on the coating, the electro-deposition being continued until the indentations are filled to the surface level of mandrel 10, as schematically indicated in FIG. 4.

The mould or mandrel 10 is now removed from the electrolyte, and the previously uncoated portions 24 of the external surface of mould 10 (between former indentations 18) are coated, and the mould presented for a second dip in an electrolyte solution, with wire 22 again electrically connected so that the mould 10 provides a cathode attracting the gold ions from the electrolyte solution. In this embodiment the second dip is of a different electrolyte concentration to that of the first dip, but the same electrolyte can if desired be used for both dips. The second dip is continued until an outer shell 26 is formed of the required thickness, with a coating of gold over the entire outer surface of the mandrel 10, except for the portion obscured by drain tube 12. It will be understood that in this embodiment, the mandrel 10 is supported in the electrolyte by drain tube 12, which thus has a dual purpose as more fully described below; but if in an alternative embodiment another support member is used, then that will also obscure a portion of the mandrel outer surface.

Since the mandrel 10 is formed of wax, if the formed body, now removed from the electrolyte, is gently heated the wax melts and flows out of the drain tube 12, whereby to leave a hollow jewellery object of gold, supported against crushing by internal integral ribs 28 also of gold (formed in the indentations 18). The opening left after removal of drain tube 12 is filled by plug 30, in this embodiment of gold.

The outer surface of the object has a uniform thickness of deposit from the second dip and thus is patterned in accordance with the required finish as determined by the external pattern of mould 10; its inner surface includes reinforcing ribs 28 in accordance with the indentations 18 made in the mould 10. Thus hollow jewellery objects can be formed by an electrolytic deposition process with a thin surface depth but which nevertheless are resistant to crushing.

Preferably a single material is used for both the reinforcement (ribs 28) and the outer shell 26 e.g. 18 carat gold, but different materials can be used for the reinforcing ribs and outer shell, providing they are compatible. In a typical example, the indentations 18 are of minimum radial depth of 1 micron; as is the minimum thickness of the shell 26, so that at a cross-section through a reinforcement the layer of gold is of thickness 2 microns.

As an alternative to coating the indentations 18, the mould 10 can be cast with the required indentation patterns in hot or cold stamping with metallic foils. The reinforcement may also include holes drilled from one side of the mandrel to the other, to connect with the peripheral coating; or alternatively to connect with the outer shell 26. In a further alternative embodiment, a matrix of indentations 18 can be provided by a preformed gold mesh, or wires impressed to the required depth in the wax mandrel 10.

The above described method may be repeated one or more times for a single object; thus the first-formed outer shell 26 is covered with wax etched with indentations as described above as a step towards forming an additional and outward shell (not shown), with the process thereafter perhaps being again repeated, to permit a required final shell thickness of 25 microns or above.

The invention described has the advantage that the hollow jewellery object can be reinforced with precious metal only at specific points or lines, and as required by the jewellery designer. The reinforcing points or lines become part of an integral outer surface, as the layer of gold or other precious metal adheres to the reinforcing lines and/or points whilst the object is being formed. Because the object is formed by an electrolytic deposition process as described above, from simple moulds or mandrels, large numbers of identical objects can be produced industrially.

I claim:

1. A method of fabricating a hollow jewellery object comprising applying a first coating of an electrically conducting material to a preselected first portion of the surface of a mandrel of insulating material whereby said surface has a coated portion and an uncoated portion, dipping said mandrel into an eletrolyte while said first coating is connected as a cathode so that positive ions from said electrolyte form a first deposit on said first coating, removing said mandrel from said electrolyte, applying a second coating of an electrically conducting material to the previously uncoated portion of the external surface of said mandrel, dipping said mandrel with said second coating into an electrolyte while said mandrel second coating is connected as a cathode to form a second deposit on the previously uncoated portion of said mandrel and also upon and integral with said first deposit.

2. A method according to claim 1 wherein the electrolyte into which said mandrel is first dipped is of the same composition as the electrolyte into which said mandrel is subsequently dipped.

3. A method according to claim 1 wherein each electrolyte includes gold ions, so that the hollow jewellery object has a maximum thickness of gold at a position which includes both a first deposit and a second deposit.

4. A method according to claim 1 in which said mandrel (10) is of a fusible material, said fusible material being melted for removal from within said hollow jewellery object following completion of said second coating.

5. A method according to claim 1 wherein said first coated portion is defined by a plurality of indentations (18) on said mandrel and wherein said first deposit is continued until said indentations are filled thereby forming internal strengthening ribs (18) for said second deposit.

6. A method according to claim 5 characterised in that said indentations (18) are interconnected, whereby said strengthening ribs form a matrix.

7. A hollow jewellery object made according to the method of any one of claim 1, 2 or 3–6 and having an outer shell conforming to an external profile of a mandrel (10) and with at least one reinforcing rib (28) located internally of said outer shell, said reinforcing rib being formed by said first deposit integral with said outer shell formed by said second deposit.

8. A hollow jewellery object according to claim 7 wherein said outer shell has a minimum thickness of 1 micron.

9. A hollow jewellery object according to claim 8 characterised in that said rib (28) has a minimum thickness of 1 micron.

10. A hollow jewellery object according to claim 7 characterised in that said rib (28) has a minimum thickness of 1 micron.

* * * * *